US005538488A

United States Patent [19]

Villepigue

[11] Patent Number: 5,538,488

[45] Date of Patent: Jul. 23, 1996

[54] EXERCISING GLOVE

[76] Inventor: James C. Villepigue, 36 Madison Pl., Roslyn Heights, N.Y. 11577

[21] Appl. No.: 488,677

[22] Filed: Jun. 8, 1995

[51] Int. Cl.[6] ..... A63B 23/16

[52] U.S. Cl. ..... 482/47; 482/44; 482/48; 601/40

[58] Field of Search ..... 482/44, 47, 48, 482/121, 124; 601/40

[56] References Cited

U.S. PATENT DOCUMENTS

| | | | |
|---|---|---|---|
| 3,347,547 | 10/1967 | Hynes | 482/47 |
| 3,944,220 | 3/1976 | Fasano | 482/47 |
| 4,602,620 | 7/1986 | Marx | 602/21 |
| 4,765,320 | 8/1988 | Lindemann et al. | 602/22 |
| 4,830,360 | 5/1989 | Carr, Jr. | 601/40 |
| 4,875,469 | 10/1989 | Brook et al. | 482/48 |
| 4,949,711 | 8/1990 | Gyovai et al. | 601/40 |
| 5,297,541 | 3/1994 | Hensey | 482/47 |
| 5,409,447 | 4/1995 | Wedge, Jr. | 601/40 |
| 5,451,191 | 9/1995 | Beenken | 601/40 |
| 5,453,064 | 9/1995 | Williams, Jr. | 482/124 X |
| 5,476,439 | 12/1995 | Robinson | 601/40 |

*Primary Examiner*—Richard J. Apley
*Assistant Examiner*—David R. Risley

[57] ABSTRACT

A glove for exercising digits of a human hand. The inventive device includes an inner glove for receiving a human hand therewithin. Digit cups are secured to the inner glove for receiving the outermost portion of each digit. A plurality of spring-loaded tension cables extend along a posterior of the glove and operate to resist motion of the glove during closing of the hand. An adjustment assembly effects tensioning of the cables to a desired resistance.

2 Claims, 3 Drawing Sheets

FIG 5
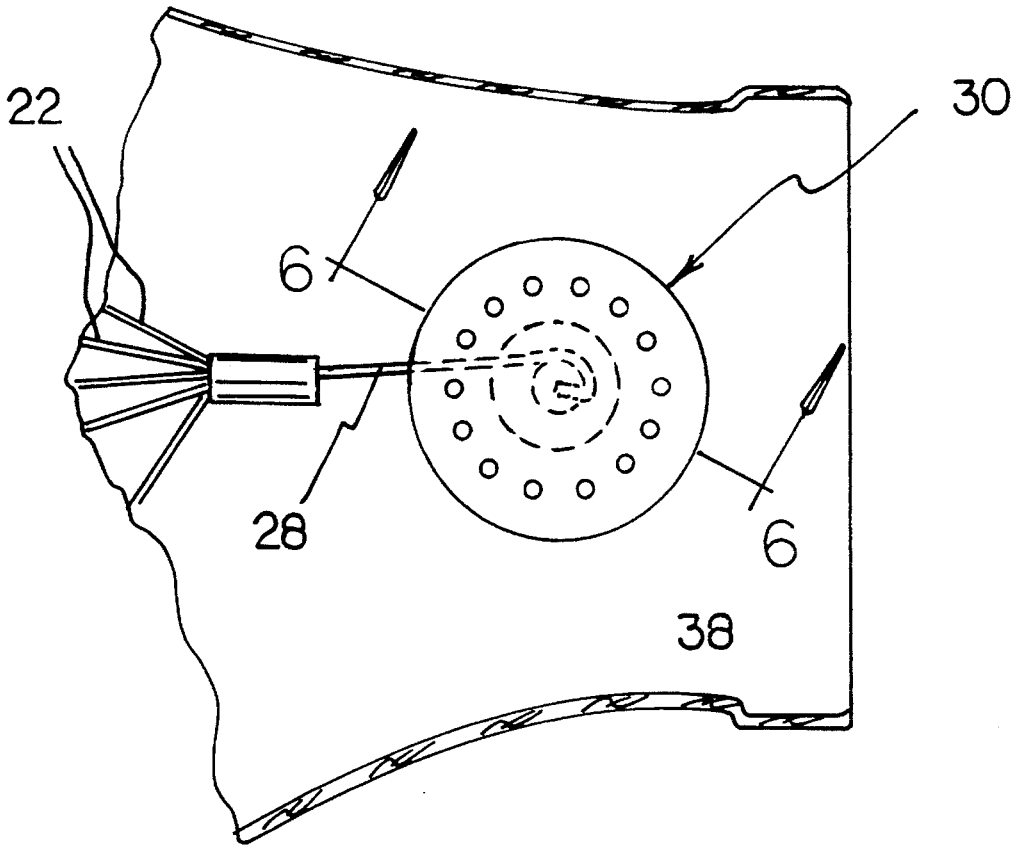
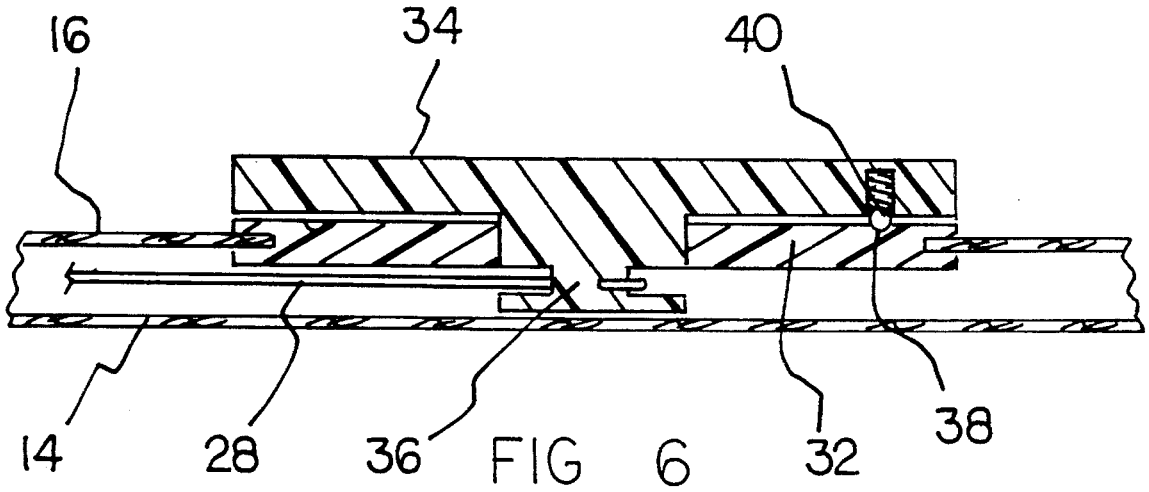
FIG 6

EXERCISING GLOVE

BACKGROUND OF THE INVENTION

1. Field of the Invention

The present invention relates to exercising devices and more particularly pertains to an exercising glove for exercising digits of a human hand.

2. Description of the Prior Art

The use of exercising devices is known in tire prior art. More specifically, exercising devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercising devices include U.S. Pat. No. 5,212,372; U.S. Pat. No. 5,297,541; U.S. Pat. No. 4,923,418; U.S. Pat. No. 4,698,850; U.S. Pat. No. 5,004,231; and U.S. Pat. No. 4,247,097.

While these devices fulfill their respective, particular objectives and requirements, the aforementioned patents do not disclose an exercising glove for exercising digits of a human hand which includes an inner glove for receiving a human hand therewithin, digit cups secured to the inner glove for receiving the outermost portion of each digit, a plurality of spring-loaded tension cables extending along a posterior of the glove and operable to resist motion of the glove during closing of the hand, and an adjustment assembly effecting tensioning of the cables to a desired resistance.

In these respects, the exercising glove according to the present invention substantially departs from the conventional concepts and designs of the prior art, and in so doing provides an apparatus primarily developed for the purpose of exercising digits of a human hand.

SUMMARY OF THE INVENTION

In view of the foregoing disadvantages inherent in the known types of exercising devices now present in the prior art, the present invention provides a new exercising glove construction wherein the same can be utilized for exercising a human hand. As such, the general purpose of the present invention, which will be described subsequently in greater detail, is to provide a new exercising glove apparatus and method which has many of the advantages of the exercising devices mentioned heretofore and many novel features that result in a exercising glove which is not anticipated, rendered obvious, suggested, or even implied by any of the prior art exercising devices, either alone or in any combination thereof.

To attain this, the present invention generally comprises a glove for exercising digits of a human hand. The inventive device includes an inner glove for receiving a human hand therewithin. Digit cups are secured to the inner glove for receiving the outermost portion of each digit. A plurality of spring-loaded tension cables extend along a posterior of the glove and operate to resist motion of the glove during closing of the hand. An adjustment assembly effects tensioning of the cables to a desired resistance.

There has thus been outlined, rather broadly, the more important features of the invention in order that the detailed description thereof that follows may be better understood, and in order that the present contribution to the art, may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical enclosure of the application. The abstract is neither intended to define the invention of the application, which is measured by the claims, nor is it intended to be limiting as to the scope of the invention in any way.

It is therefore an object of the present invention to provide a new exercising glove apparatus and method which has many of the advantages of the exercising devices mentioned heretofore and many novel features that result in a exercising glove which is not anticipated, rendered obvious, suggested, or even implied by any of the prior art tool guides, either alone or in any combination thereof.

It is another object of the present invention to provide a new exercising glove which may be easily and efficiently manufactured and marketed.

It is a further object of the present invention to provide a new exercising glove which is of a durable and reliable construction.

An even further object of the present invention is to provide a new exercising glove which is susceptible of a low cost of manufacture with regard to both materials and labor, and which accordingly is then susceptible of low prices of sale to the consuming public, thereby making such exercising gloves economically available to the buying public.

Still yet another object of the present invention is to provide a new exercising glove which provides in the apparatuses and methods of the prior art some of the advantages thereof, while simultaneously overcoming some of the disadvantages normally associated therewith.

Still another object of the present invention is to provide a new exercising glove for exercising digits of a human hand.

Yet another object of the present invention is to provide a new exercising glove which includes an inner glove for receiving a human hand therewithin, digit cups secured to the inner glove for receiving the outermost portion of each digit, a plurality of spring-loaded tension cables extending along a posterior of the glove and operable to resist motion of the glove during closing of the hand, and an adjustment assembly effecting tensioning of the cables to a desired resistance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an enlarged cross sectional view of the invention illustrating an adjustment means thereof.

FIG. 6 is a cross sectional view taken along line 6—6 of FIG. 5.

DESCRIPTION OF THE PREFERRED EMBODIMENT

Figure 1:
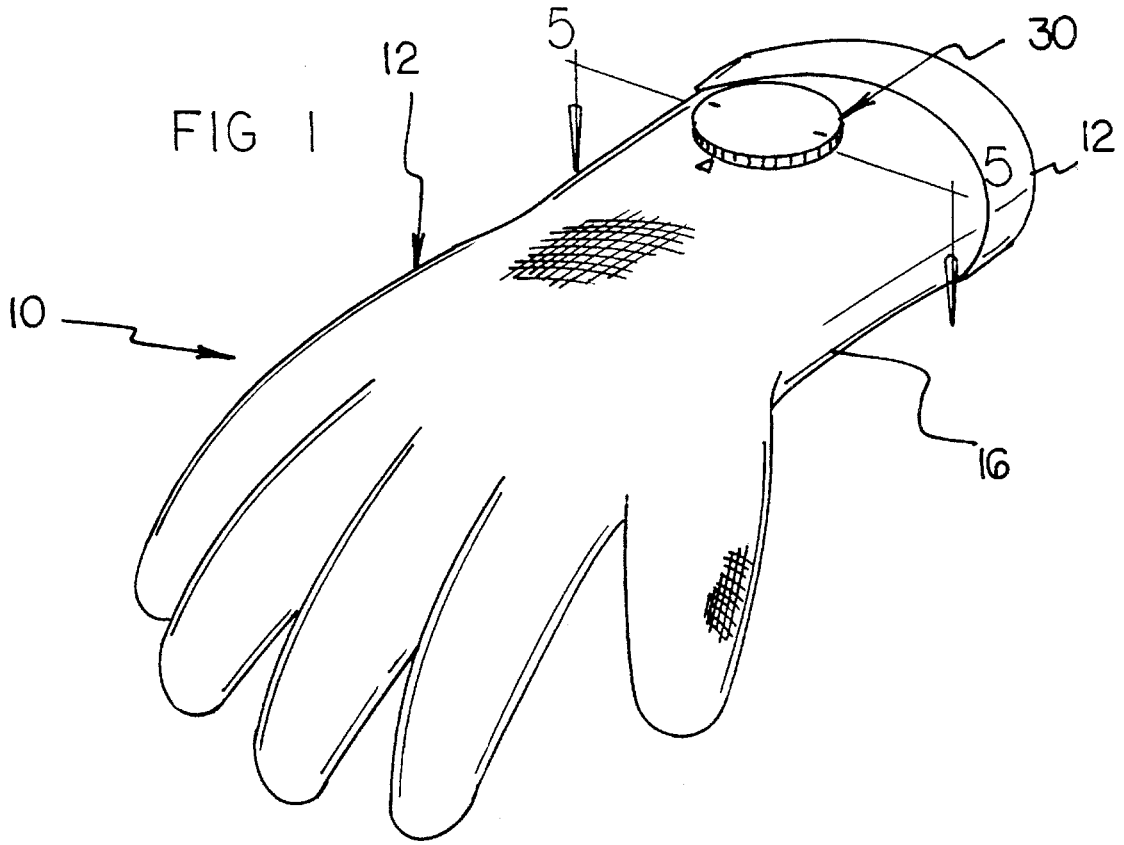
FIG. 1 is an isometric illustration of an exercising glove according to the present invention.

With reference now to the drawings, and in particular to FIGS. 1–6 thereof, an exercising glove embodying the principles and concepts of the present invention and generally designated by the reference numeral 10 will be described.

Figure 3:
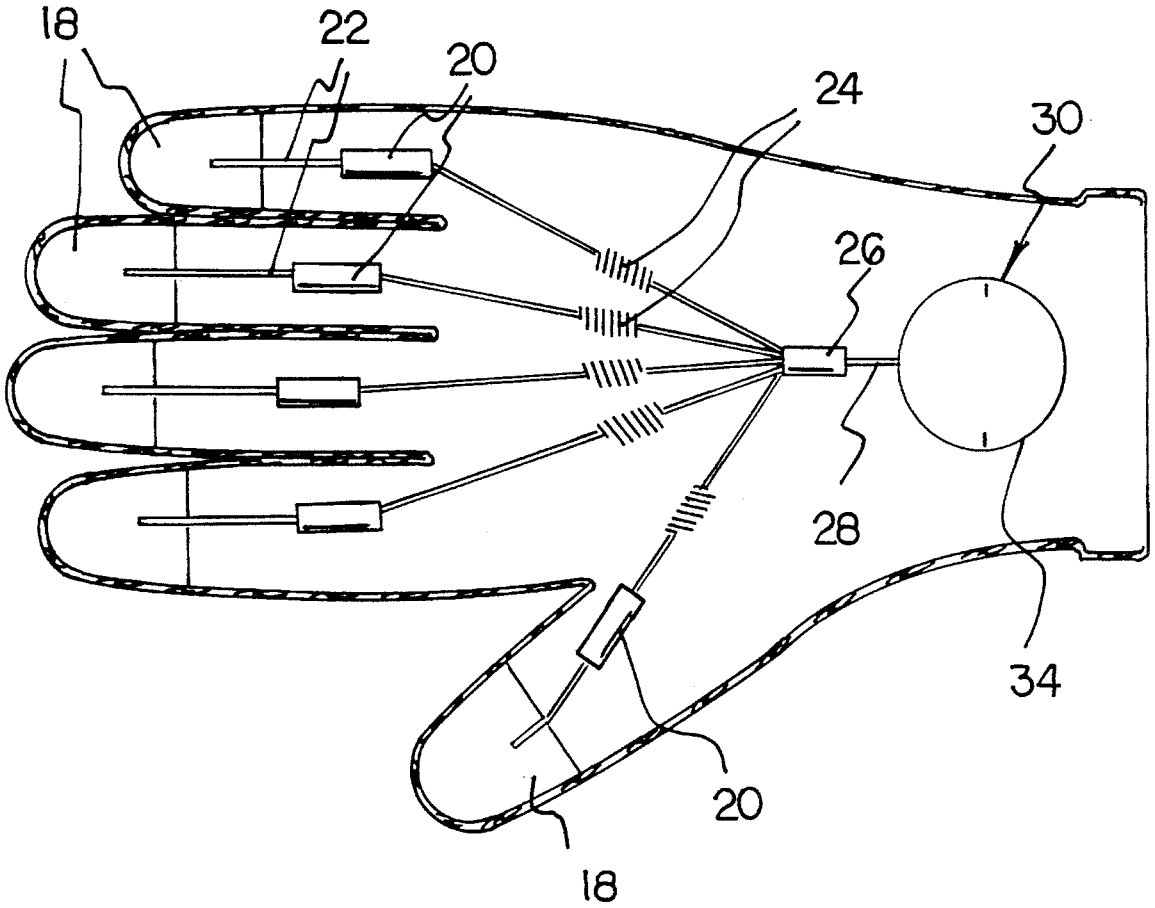
FIG. 3 is a cross sectional view of the invention.
Figure 4:
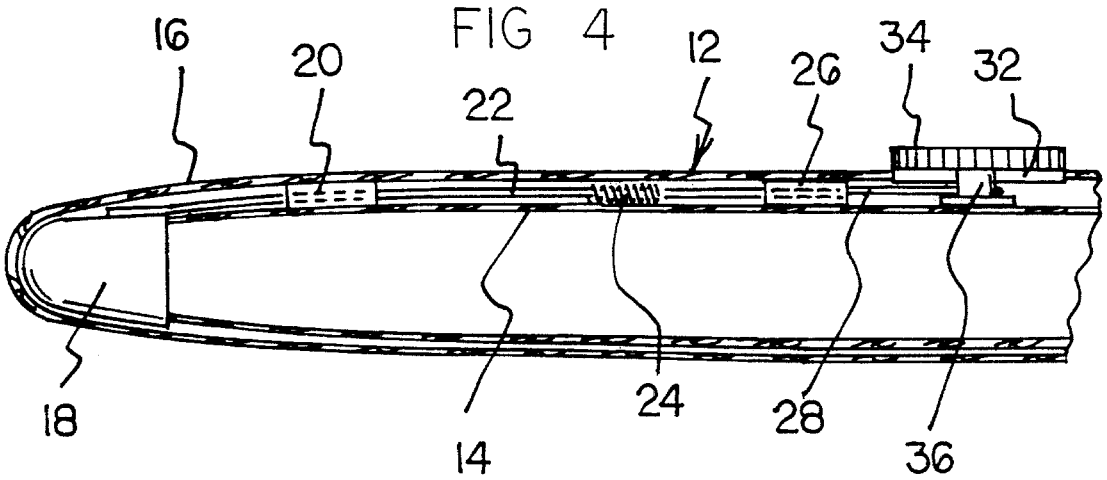
FIG. 4 is a further cross sectional view of the invention.

More specifically, it will be noted that the exercising glove 10 comprises a glove 12 for receiving a human hand therewithin. The glove 12 includes an inner glove 14, as shown in FIG. 4, which is preferably surrounded by an outer cover 16. The inner glove 14 is shaped so as to define a plurality of pockets each receiving an individual digit of a human hand. A digit cup 18 is secured to an outermost end of each of the pockets of the inner glove 14 so as to at least partially surround an individual digit of a human hand positioned within the device 10. A plurality of guide tubes 20 are positioned along a posterior portion of the inner glove 14 and interposed between the outer cover 16 and the inner glove 14 of the glove 12. A plurality of tension cables 22 are coupled to the digit cups 18 and extend through the guide tubes 20, as best illustrated in FIG. 3 of the drawings. The tension cables 22 each extend from an individual one of the digit cups 18 and include a spring member 24 which can be elastically elongated. The tension cables 22 continue beyond the spring members 24 and are coupled together by a joiner 26 from which an anchor wire 28 extends. The anchor wire 28 is secured relative to the inner glove 14, whereby an individual wearing the device 10 can articulate digits of the human hand so as to tension the spring members 24 during closing of the hand to effect exercising of individual digits of the hand.

As shown in FIGS. 1 through 4, and more particularly in FIGS. 5 and 6, it can be shown that the present invention further comprises an adjustment means 30 for selectively tensioning the spring members 24. To this end, the adjustment means 30 preferably comprises an adjustment knob mounting plate 32 secured to the outer cover 16 and shaped so as to define a through-extending aperture. An adjustment knob 34 is rotatably positioned relative to the adjustment knob mounting plate 32 and includes an adjustment knob axle 36 directed through the aperture in the mounting plate as shown in FIGS. 4 and 6. The anchor wire 28 is coupled to the adjustment knob axle 36 such that a rotation of the adjustment knob 34 will effect tensioning of the anchor wire 28, as well the tension cables 22 and the spring-members 24, thereby providing increased resistance to closing of a human hand positioned within the device 10. To retain the adjustment knob 34 of the adjustment means 30 in a desired position, the mounting plate 32 is shaped so as to define a plurality of detent notches 38 directed thereinto and positioned in a radially spaced orientation relative to one another. A spring-loaded detent ball 40 is mounted within a cylindrical bore directed into a lower surface of the adjustment knob 34 and positioned for engagement with an individual one of the detent notches 38. By this structure, the spring-loaded detent ball 40 engages any one of the detent notches 38 so as to retain the adjustment knob 34 in a desired angular orientation.

Figure 2:
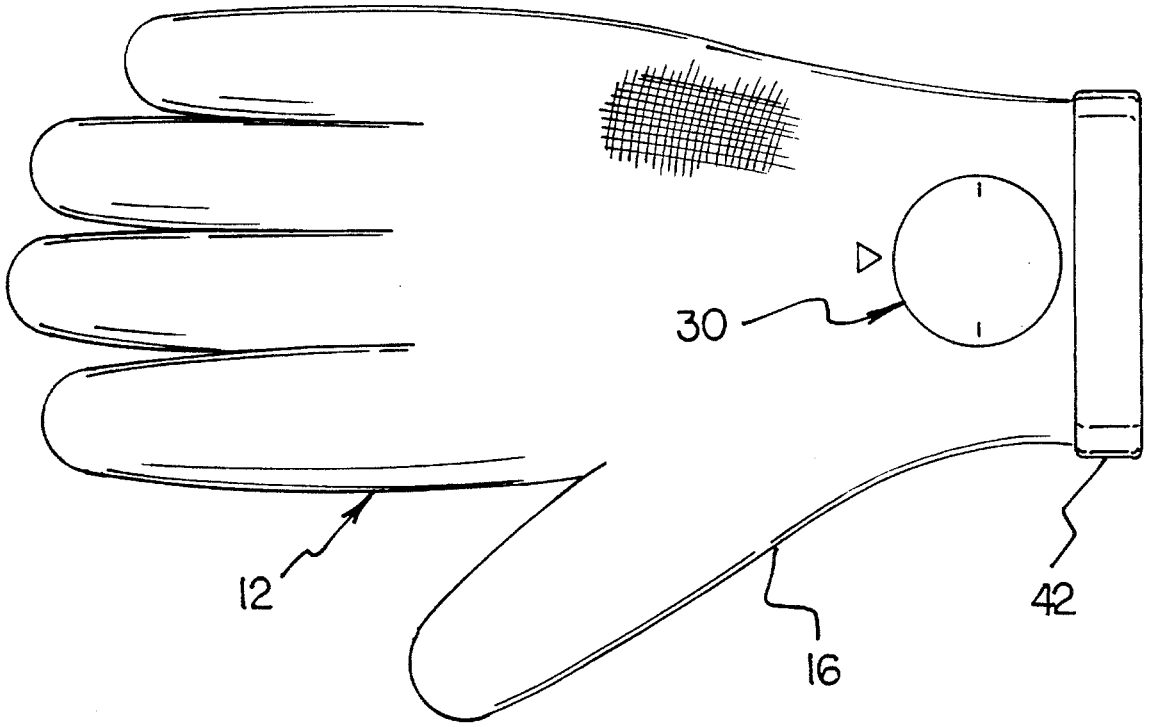
FIG. 2 is a top plan view of the invention.

As shown in FIGS. 1 and 2, the glove 12 further comprises a wrist strap 42 for securing the device 10 about a hand of a user. The wrist strap 42 can be elastic such that a resilient contraction of the wrist strap about the wrist of an individual secures the device 10 relative thereto. Alternatively, conventionally known straps and securing buckles can be utilized to further secure the glove 12 to a wrist of an individual.

In use, the exercising glove 10 according to the present invention can be easily utilized for exercising digits of a human hand. To this end, each individual digit can be separately articulated relative to a adjacent digits, or alternatively, all digits can be moved simultaneously. The adjustment means 30 can be selectively adjusted to permit tensioning of the spring members 24 to a desired resistance according to the needs of desires of an end user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise glove comprising:

a glove for receiving a human hand therewithin, the glove including a plurality of pockets each adapted for receiving an individual digit of a human hand, the glove shaped so as to define the plurality of pockets;

a plurality of digit cups secured to an outermost end of each of the pockets of the glove;

a plurality of tension cables each being coupled to an individual one of the digit cups and extending along a posterior portion of the glove, an outer cover surrounding the inner glove with the tension cables extending between the inner glove and the outer glove, the tension cables each including a spring member which can be elastically elongated, the tension cables being fixed to a portion of the glove such that an individual wearing the glove can articulate digits of the human hand so as to tension the spring members during closing of the hand to effect exercising of individual digits of the hand, the tension cables continuing beyond the spring members and coupled together and an anchor wire coupled to the joined tension cables, the anchor wire being fixed relative to the glove; and adjustment means comprising an adjustment knob mounting plate secured to the outer cover and shaped so as to define a through-extending aperture and an adjustment knob rotatably positioned relative to the adjustment knob mounting plate and including an adjustment knob axle directed through the aperture in the mounting plate with the anchor wire being coupled to the adjustment knob axle such that a rotation of the adjustment knob will effect tensioning of the tension cables and the spring members.

2. The exercising glove of claim 1, wherein the mounting plate is shaped so as to define a plurality of detent notches directed thereinto and positioned in a radially spaced orientation relative to one another; and further comprising a spring-loaded detent ball mounted to the adjustment knob between the adjustment knob and the mounting plate, the detent ball being positioned into engagement with an individual one of the detent notches.

* * * * *